United States Patent [19]

Greaves

[11] 4,029,220

[45] June 14, 1977

[54] DISTRIBUTOR MEANS FOR CHARGING PARTICULATE MATERIAL INTO RECEPTACLES

[76] Inventor: Melvin J. Greaves, 9995 Cliff Drive, Cleveland, Ohio 44102

[22] Filed: Nov. 28, 1975

[21] Appl. No.: 636,165

[52] U.S. Cl. ..... 214/35 R; 193/29; 266/183

[51] Int. Cl.[2] ..... F23K 3/18

[58] Field of Search ..... 193/3, 12, 13, 29; 214/35 R, 17 CB, 18 V; 266/176, 183

[56] References Cited

UNITED STATES PATENTS

| | | | |
|---|---|---|---|
| 1,284,694 | 11/1918 | Jefferies | 214/18 V |
| 1,869,628 | 8/1932 | Stock, Jr. | 193/12 X |
| 3,014,603 | 12/1961 | Taubmann | 214/18.2 |
| 3,077,274 | 2/1963 | Kitzrow | 214/18.2 X |
| 3,278,054 | 10/1966 | Stott | 193/12 X |
| 3,966,062 | 6/1976 | Sakai | 266/183 X |

FOREIGN PATENTS OR APPLICATIONS

| | | | |
|---|---|---|---|
| 1,045,106 | 11/1958 | Germany | 266/176 |

*Primary Examiner*—Robert J. Spar

*Assistant Examiner*—Carl Rowold

[57] ABSTRACT

Disclosed are receptacles, such as shaft furnaces illustrated by a blast furnace and an upright oil shale retort, embodying rotatable charge distributor means for distributing particulate charge material in the furnace, which charge distributor means can provide a high uniformity of distribution of various sizes of particles and also can provide and maintain a stock line of desired contour and heighth in the receptacle. The distributor means includes a hopper having rigidly fixed to it a plurality of downwardly extending chutes with lower discharge portions that discharge in concentric circular zones at the stock line. The distributor means includes a segmented portion at the juncture of the hopper and the chutes that divides the charge material discharged into the hopper in proportion to the area of the circular zone at the stock line that is fed by the chute. The distributor means embodies means for providing mass flow of the particulate charge material through the chutes to the stock line and for avoiding segregation between larger and smaller particles of charge material deposited at the stock line.

20 Claims, 18 Drawing Figures

FIG. 5
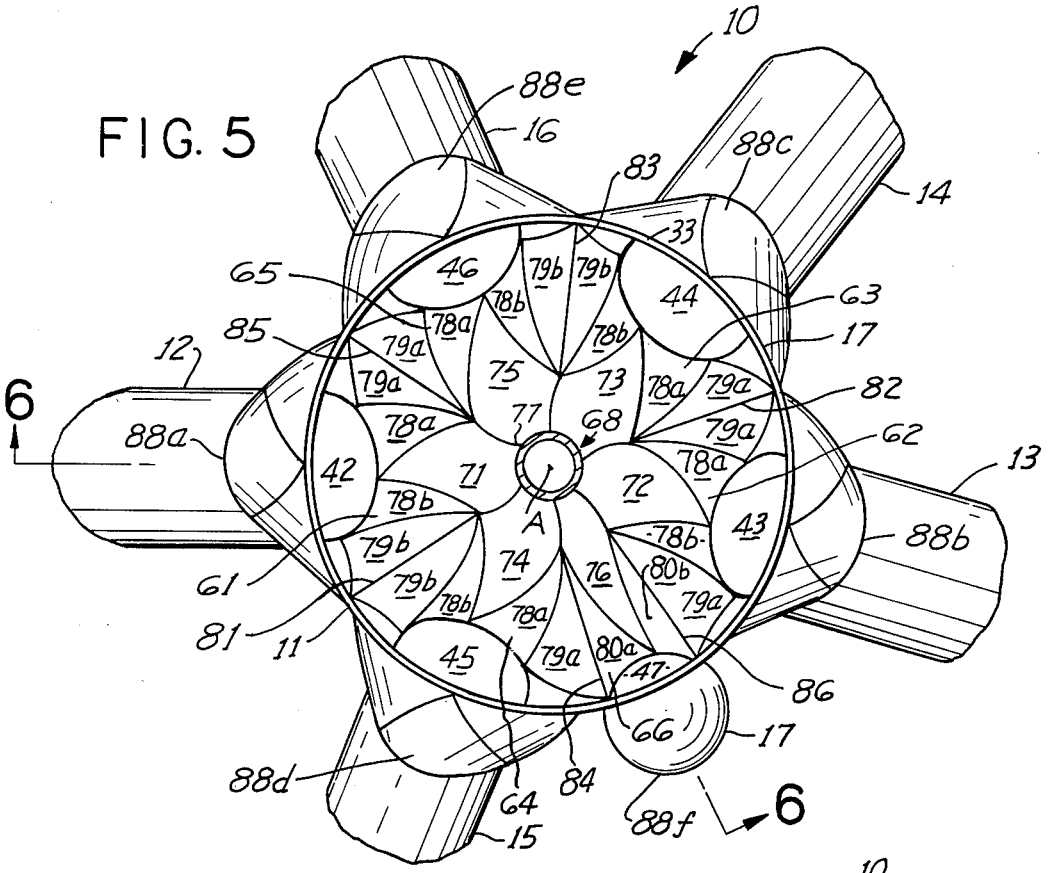
FIG. 7
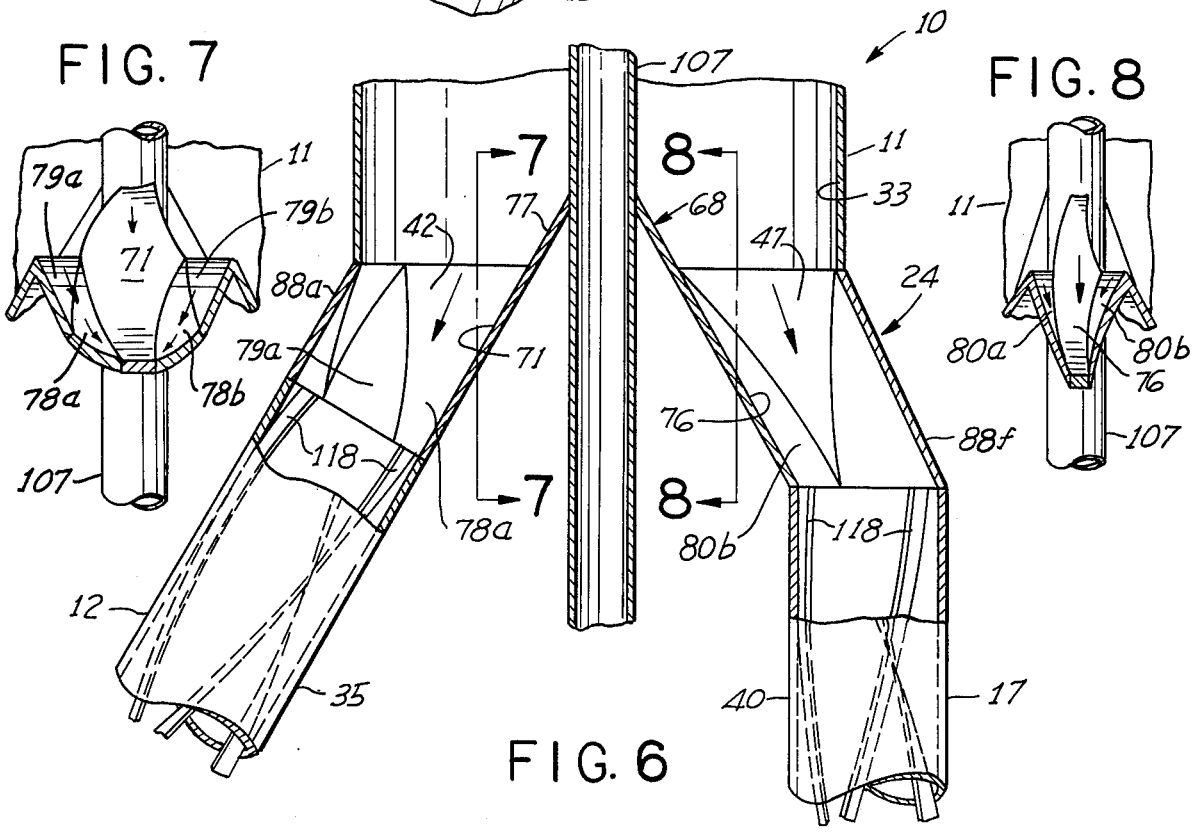
FIG. 8
FIG. 6

DISTRIBUTOR MEANS FOR CHARGING PARTICULATE MATERIAL INTO RECEPTACLES

This invention resulted from work done under Lease Agreement dated May 11, 1972, between the United States (represented by Honorable Rogers C.B. Morton, Secretary of the Interior) and Development Engineering, Incorporated.

DISCLOSURE OF THE INVENTION

1. Field of the Invention

This invention relates to apparatus for charging particulate material into a receptacle such as a blast furnance, upright oil shale retort, coal gasifier, or a pyroprocessing preheater, kiln, or cooler. More particularly it pertains to apparatus for charging particulate charge material into such a receptacle to distribute the material in the receptacle to provide a level or desired shape of the top surface or stock line of the material in the receptacle and high uniformity of distribution of sizes of particulate material in the body of charge material in the receptacle.

2. Background of the Invention

While the invention may be used for other purposes, it provides particular advantages when used as a distributor for distributing particulate charge material into an upright blast furnace, and for distributing particulate oil shale material into an upright oil shale retort; and therefore the invention will be discussed below as so used.

In general, the typical blast furnace for reducing iron oxide, as in the form of iron ore or pellets, has an upright stack furnace portion into which particulate charge material is introduced at the top and through which the charge material moves downwardly as the charge material is heated under reducing conditions to produce metallic iron which collects in the hearth portion from which it is tapped. Air, with or without added materials, is introduced through tuyeres at the lower portion of the furnace in known manner for combustion purposes. In known manner, hot gas resulting from combustion of constituents of the charge material passes upwardly through the body of charge material in the furnace to the space above the stockline, from which it is withdrawn. In present practice, for efficiency, large diameter, large capacity furnaces are used, as well as relatively high gas pressures.

In blast furnaces for reducing iron ore to iron metal, as in similar blast furnaces for reducing other matierals, it is desirable to have a charge distributor that will distribute and maintain charge material in a body that has a stock line that is level or of other desired contour at a predetermined height across the cross section of the upper portion of the furnace, and to distribute the charge material so that there is a uniform distribution of particle sizes in the body of charge material in the furnace. Otherwise, channeling of hot gases upwardly through the mass of the C. B. material in the furnace will result, causing unsatisfactory operation, including inefficient or interrupted operation and possible danger.

Thus, unsatisfactory operation can occur because clinkers, or other large particles in the charge material, that are segregated in the body of charge material because of non-uniform distribution, permit gas to channel through the portions of the body containing the segregated larger particles, leaving other portions of the body of charge material insufficiently treated to reduce satisfactorily the iron oxide portion.

Similar channeling can occur if the stock line of the charge material in the furnace varies substantially in height, since the gas will preferentially flow through the lowest portions of the stockline.

Many prior blast furnace distributors do not satisfactorily provide the desired results, or if they do, they are undesirably expensive and complicated in construction and operation. Problems in blast furnaces are also accentuated because the temperature at the top of the furnace is high and furnace atmosphere is dust-laden, so that complicated systems involving relatively moving parts within the furnace are subject to undesirable and difficult maintenance problems.

Rotating types of distributors heretofore proposed for use in blast furnaces have been deficient in that they did not insure that the charge material was distributed as desired in the furnace, did not provide a substantially uniform mixture of large and small pieces of charge material, and did not maintain a desired contour and level of stock line. Thus, for example, if the charge material should be supplied by a belt or other means so that finer particles of charge material should be located and discharged from a fixed location at one side of the axis of a rotating distributor, then the rotating distributor would cause the fines to be largely distributed over only about half of the cross section of the furnace to one side of the center line of the furnace cross section. This is highly disadvantageous because the fines tend to form clinkers that can cause the above indicated problems.

Similar problems occur in oil shale retorts. In general, the known upright oil shale retort used for recovering oil from crushed particulate oil shale, has an upright stack furnace portion into which particulate oil shale is introduced at the top to form a body of oil shale in the retort, through which the oil shale moves downwardly as the shale is heated to remove the kerogen or other oil-containing material, fuel gas, and other constituents, after which the spent oil shale is discharged from the bottom of the furnace portion.

Between the upper and lower portions of body of shale in the retort, means is provided to heat the particulate oil shale to drive off the oil-containing constituents and fuel gas. Recycled gas mixed with a predetermined amount of air is supplied to the heating means in an amount predetermined to burn residual carbon on the oil shale to provide heat for driving off the oil-containing constituents and fuel gas. Air is also supplied from the bottom or generally midway of the retort and travels upwardly through the body of shale; as the air progresses upwardly it cools the hot spent shale and itself is preheated; the air is used in combination with the fuel-air mixture at the heating means to burn residual carbon and provide necessary heat for the process. The oil-containing constituents and fuel gas removed by heat from the shale, in the form of oil vapor with gas and water vapor, moves upwardly through the body of oil shale and enters the space above the oil shale in the upper portion of the retort from which it is removed. This mixture of oil and gas and water vapor is hot, and this preheats the oil shale as it moves downwardly in the body of shale in the retort.

In such an oil shale retort it is very desirable to have a distributor that will distribute and maintain particulate oil shale charge material in a body in the retort that has a stock line that is level or of other desired contour at a predetermined height across the cross section of the upper portion of the furnace and to distribute the charge material so that it has a uniform distribution of particle sizes. Otherwise, channeling of hot gas upwardly through the body of charge material in the furnace will result, with adverse results, including inefficient operation and possible danger.

Distributors heretofore proposed for distributing the pretreated oil shale in the upper part of the retort have been deficient in various respects. Rotating types of distributors heretofore proposed have been deficient in that they did not insure that the particulate oil shale was spread uniformly, did not provide a substantially uniform mixture of large and small pieces of oil shale, and did not maintain a desired height and contour of stock line. For example, if the oil shale should be supplied by a distributing belt and the finer particles of oil shale should be located on and discharged at one side of the belt into the rotating distributor, then the rotating distributor would cause the fines to be largely distributed over only about half of the cross section of the retort.

This is highly disadvantageous because the oil shale fines tend to form clinkers which cause non-uniform operation of the retort, and in fact failure of operation at times. Non-uniform operation occurs because accumulations in the body of oil shale in the retort of clinkers, or other larger sizes of oil shale particles caused by non-uniform distrbution, permit gas and vapors to channel through such accumulations, leaving other portions of the body of oil shale insufficiently treated to remove oil and other desired material therefrom.

Consequently, in these respects, problems in oil shale retorts and blast furnaces are similar, in that both types of apparatus have similar requirements for distribution of the charge material in the furnace.

SUMMARY OF THE INVENTION

It is an object of the invention to avoid the above and other problems and disadvantages of prior art apparatus.

It is a further object of the invention to provide apparatus for charging material into a receptacle such as those mentioned above, that will operate efficiently in large or small receptacles, to charge desired quantities of particulate charge material, to provide and maintain the desired height of charge material in the receptacle, to provide a desired level stock line or other contour of stock line depending on design of the apparatus, and to provide a highly uniform distribution of particle sizes of charge material across the receptacle.

The present invention provides apparatus for charging particulate charge material into a receptacle comprising an upright portion adapted to have particulate charge material deposited therein in a body having an upwardly facing stock line; charge distributing means for distributing charge material in the upper portion of the receptacle, the charge distributing means being rotatable about an upright axis and comprising hopper means having an upper portion adapted to have charge material discharged therein and having at its lower portion a plurality of discharge chutes rigidly fixed to said hopper means, each of the chutes having a lower discharge portion that moves in a circular path concentric with and transverse to the axis of rotation as the charge distributor means rotates, the discharge portions of all of the chutes being located so that they discharge material in concentric circular zones that are radially offset in the receptacle so that the material discharged from said discharge portions is discharged over at least a major portion of cross section of said receptacle to the stock line. The hopper portion of the structure has means for distributing the proper amounts of material into the various chutes to provide the desired amount of charge material to be distributed in each zone.

Furthermore, the hopper and each of the chutes preferably is designed and constructed to provide mass flow of the charge material as it flows through each chute to the stock line, by providing a rotational effect on the mass of material traveling through the chute, to mix back into the mass of material flowing through the chute any finer particles that tend to segregate from larger particles, thus eliminating segregation between finer particles of charge material and larger particles of charge material as the charge material is discharged from the chute.

It is a further object to provide discharge means at the discharge end of each chute that discharges the particulate charge material without degradation of the charge material and that forms a circular zone of material at the stock line of substantially uniform height throughout the zone.

A further object is the provision of means for maintaining, within the rotating hopper of the distributor apparatus, charge material in a body having a top surface that is at a substantially uniform height above the bottom of the hopper to avoid segregation of larger and smaller particles in the hopper that could cause segregation between larger and smaller particles in localized portions of the body of charge material in the receptacle filled by the distributor apparatus.

BRIEF DESCRIPTION OF THE DRAWINGS

These and other advantages of the invention will become apparent from the following description of several preferred embodiments in connection with the accompanying drawings:

FIG. 5 is an enlarged plan of the hopper portion of the distributor means;

FIG. 6 is a sectional view along line 6—6 and to the same scale;

FIG. 7 is a section along line 7—7 of FIG. 6 and to the same scale;

FIG. 8 is a section along line 8—8 of FIG. 6 and to the same scale;

DESCRIPTION OF THE PREFERRED EMBODIMENTS

Figure 1:
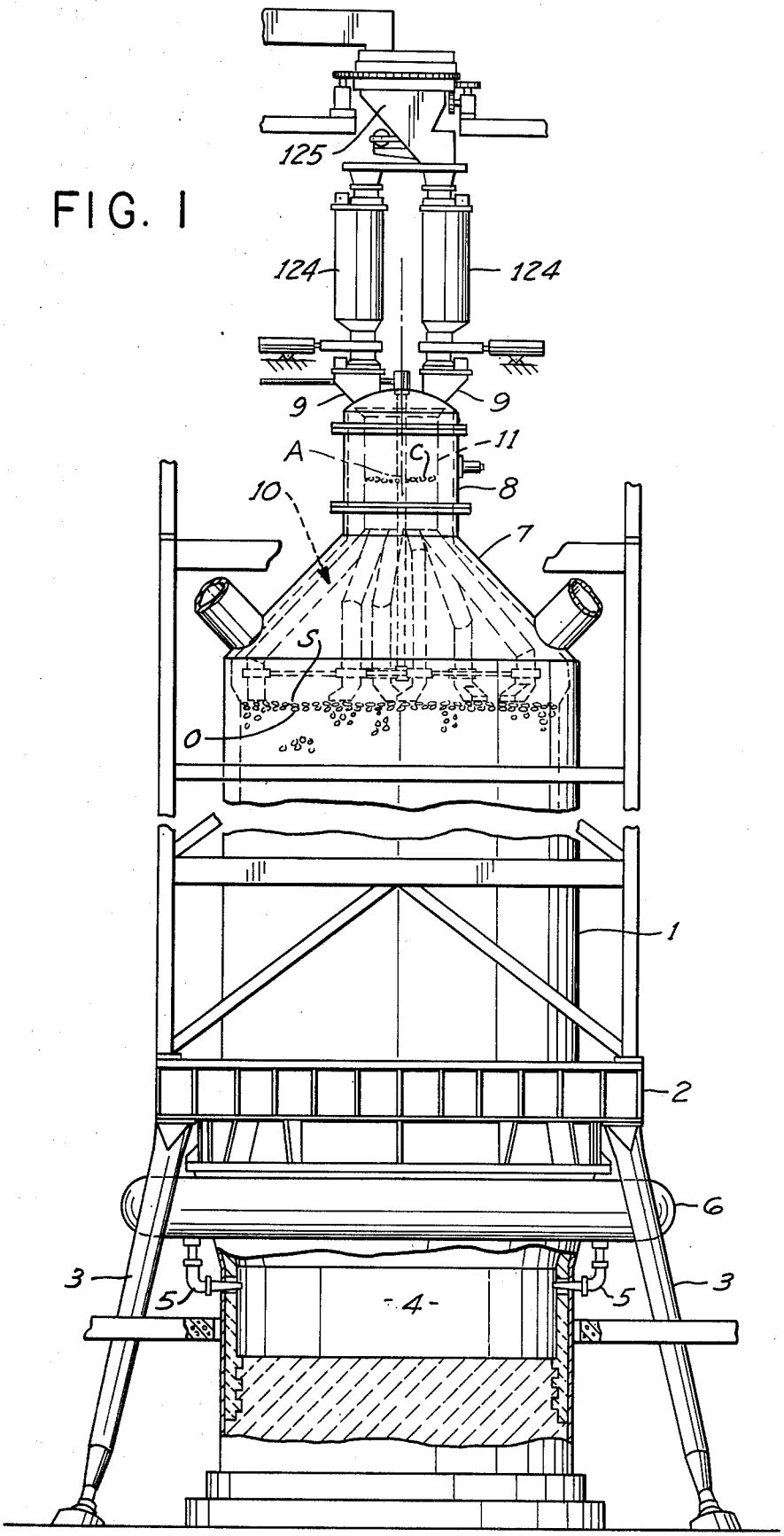
FIG. 1 is an exterior view of blast furnace apparatus embodying the invention.
Figure 2:
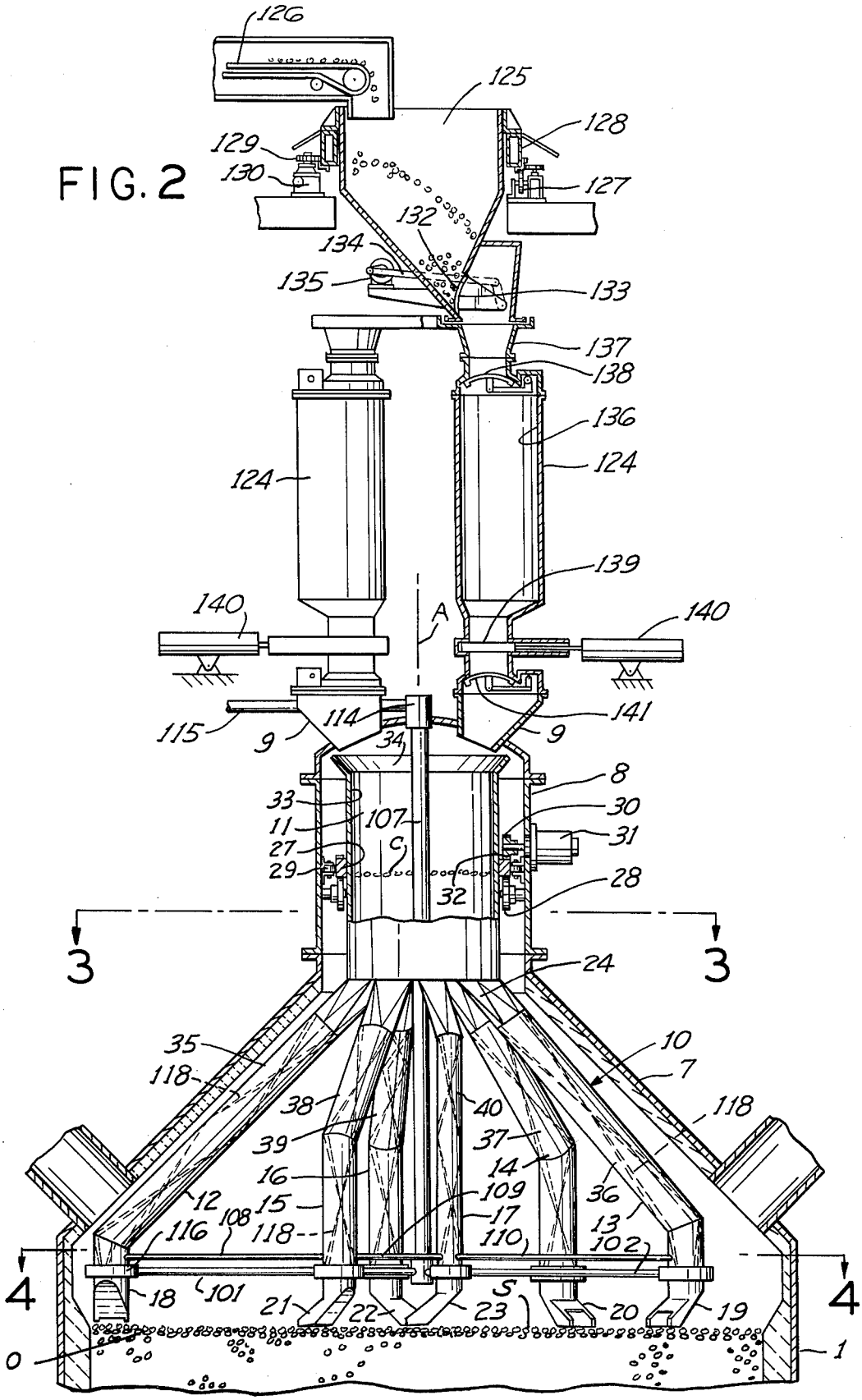
FIG. 2 is a view to a larger scale of the upper portion of the apparatus of FIG. 1 showing charge distributor means embodying the invention.
Figure 3:
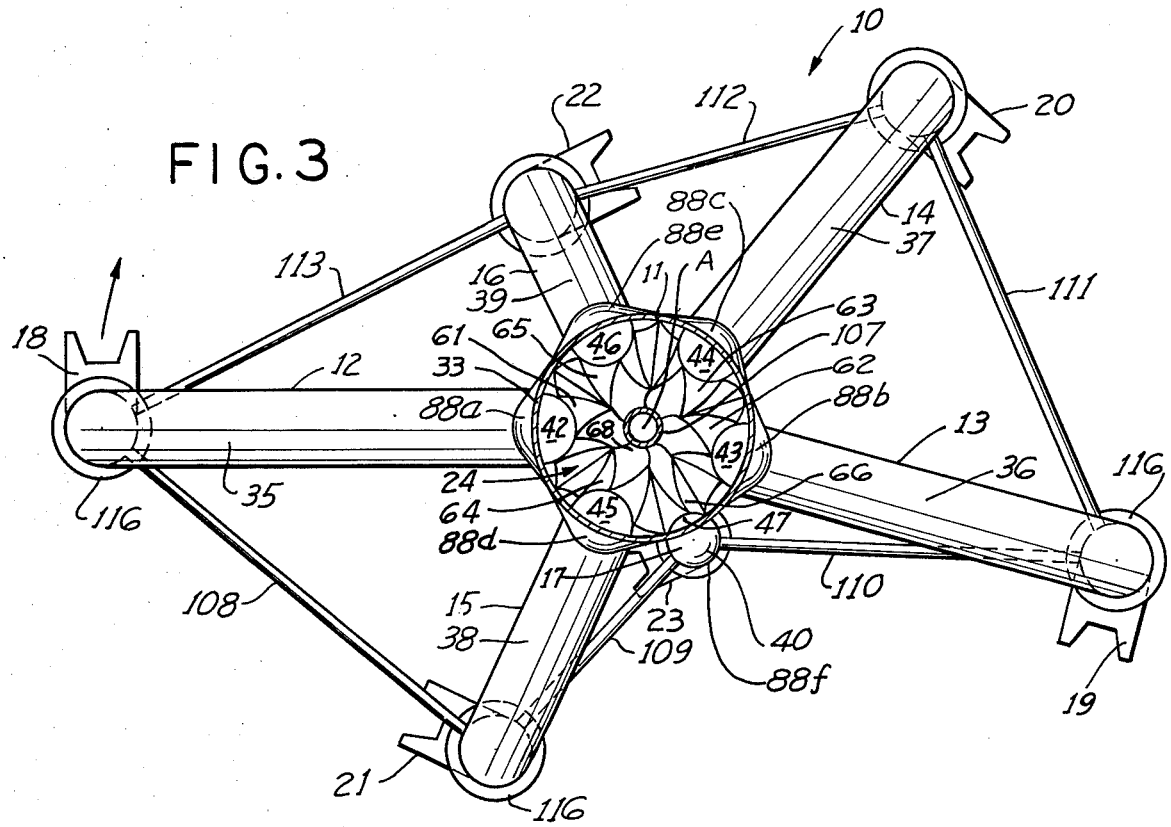
FIG. 3 is a plan view along line 3—3 of FIG. 2 of the rotatable charge distributor means comprising a central hopper and a plurality of chutes, the remainder of the apparatus of FIG. 1 being omitted.
Figure 4:
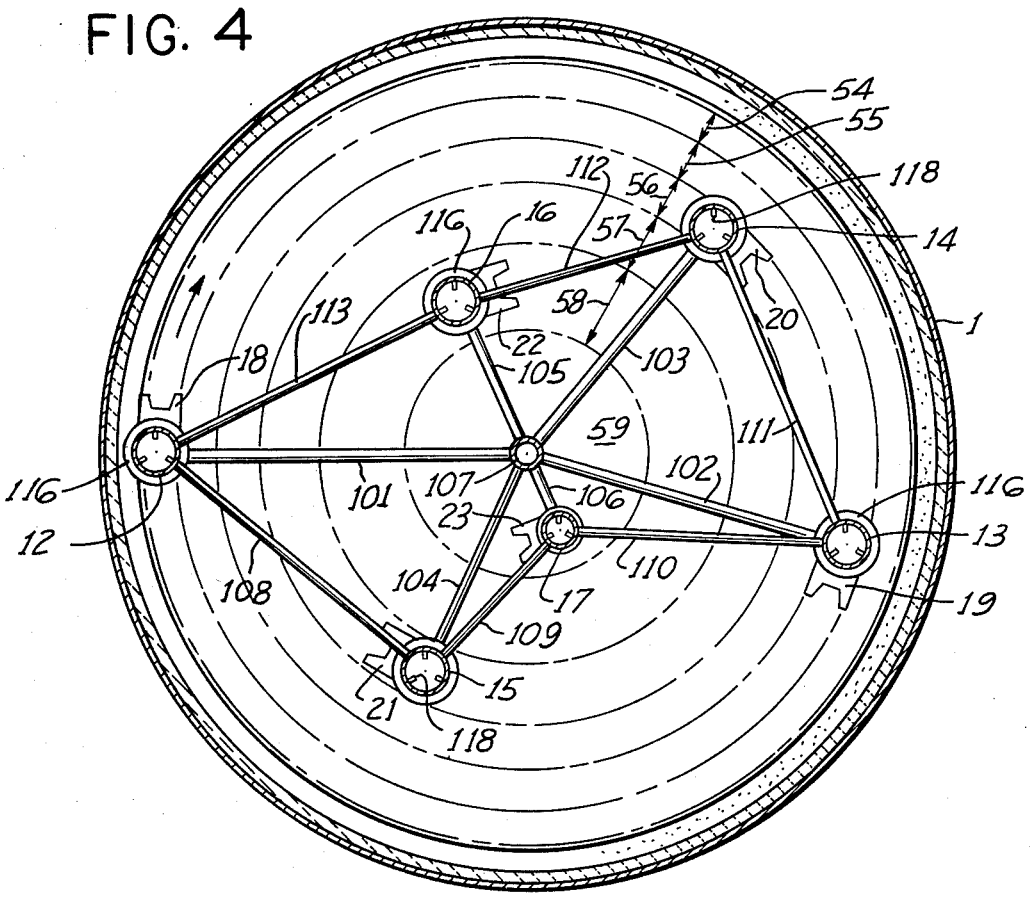
FIG. 4 is a section along line 4—4 of FIG. 2 showing the lower portion of the chutes of the charge distributor means and reinforcing means connected to the chutes to provide a rigid structure.

FIGS. 1 and 2 depict an illustrative blast furnace for reduction of iron ore to iron metal, embodying the invention.

The embodiment of these figures comprises a known type of blast furnace comprising an upstanding furnace chamber 1 of generally known construction mounted on a rigid frame 2 supported by spaced legs 3. The furnace comprises a known type of hearth portion 4 into which air and if desired additional material, is blown through tuyeres 5 connected to a bustle pipe 6.

The upper portion of the furnace comprises a frustoconcial shell portion 7 terminating in upwardly extending cylindrical portion 8 having a closed top in which are a plurality of closeable and openable port members 9 through which charge material is supplied. A charge distributor means 10 embodying the invention is located within the upper portion of the furnace to discharge charge material into the furnace to form a body O having a stock line S.

Distributor means 10 comprises an upper hopper 11 having fixed to it downwardly extending chutes 12 – 17 respectively having bottom discharge portions 18 – 23, disclosed below, that are so constructed and spaced that as the distributor means rotates about a vertical axis A the discharge portions of the chutes discharge charge material in radially offset concentric circular zones, corresponding in number to the chutes, that in total cover substantially the entire cross sectional area of the stock line S as described later. Hopper 11 also has a lower segmented transition portion 24, described later, that assures that the proper proportions of the charge material are discharged into the chutes to be laid down in proper amounts in the concentric zones to provide and maintain the desired stock line contour and level. The distributor means, including its chutes, also comprise means, to be indicated later, that insures that there is little if any segregation of larger and smaller particles in the charge material that is discharged from the chutes.

Distributor means 10 (FIG. 2) is supported for rotation within the cylindrical portion 8 of the furnace shell by a ring member 27 fixed to the exterior of the hopper and supported by spaced rollers 28 mounted for free rotation about horizontal axes in shell portion 8, and located transversely by rollers 29 freely rotatably mounted about vertical axes in shell portion 8.

The hopper 11, and hence the distributor means 10 as a whole, is rotated by a gear 30 driven by suitable power means 31 and engaging gear teeth 32 on top of ring member 27.

In the distributor means 10 of FIGS. 1–12, hopper 11 has an upstanding cylindrical side wall 33 providing an open top 34. The chutes 12–17 respectively have downwardly extending tubular portions 35 to 40 of which portions 35, 36, 37, 38 and 39 have inclined portions of substantial lengths. The upper ends of all tubular portions 35–40 respectively open at 42–47 (FIG. 5) into the hopper 11 and the lower ends respectively have discharge portions 18–23.

The discharge portions of the chutes respectively are located at spaced positions angularly around the axis of rotation A. They are also spaced at different distances radially from axis A, so that each discharge portion discharges charge material in its corresponding circular zone 54 to 59, that in total cover essentially the entire area of cross section of the furnace interior at the stock line as the chutes rotate in fixed relation to each other in the direction indicated by the arrows in FIGS. 3 and 4, which is clockwise in the illustrated embodiment. In this embodiment, zones 54–58 are annular, and central zone 59 is not.

The transition portion 24 (FIGS. 2, 3, 5–8) at the juncture of the lower portion of hopper 11 and each of the upper openings 42–47 of the chutes is divided to provide segments 61–66 so that the charge material deposited in the hopper as it rotates is divided among the chutes in such manner that the amount of charge material passing through each chute and discharged from its lower discharge portion during one revolution of the chute is sufficient to deposit in the corresponding zone 54–59 served by such discharge portion an amount of charge material that fills the area of the zone to a predetermined height, preferably corresponding to the same height of charge material deposited in the other zones if a flat stock line S is desired. Consequently, a highly uniform bed of charge material is laid down entirely across the cross section of the retort. Perferably, in normal operation, each chute through its discharge portion deposits in its circular zone a layer of material at least as thick as the maximum average cross sectional dimension of the largest particles in the charge material, but only moderately thicker than such dimension.

Segments 61–66 each discharge into a corresponding opening 42–47. These segments are defined by a raised central portion 68 of Generally star-shaped configuration when viewed in plan, having wedge shaped portions 71–76 that extend and downwardly incline from a central raised portion 77 downwardly into openings 42–47. These wedge shaped portions, in combination with side wall portions 78*a*, *b* and 79*a*, *b* in each segment 61–65 and side wall portions 80*a*, *b* in segment 63, define the segments 61–66 which are bounded by radial ridges 81–86 from which the side wall portiond 78*a*, *b* 79*a*, *b* and side wall portions 80*a*, *b* slope downwardly and outwardly in gable-like relation. The outer portions of the segments are closed by walls 88*a–f* forming part of transition portion 24. The portions of the above indicated parts forming the segments discharging into the openings 42–47 are proportioned to give the result described in the previous paragraph.

While the hopper is rotating, it is supplied with charge material from a fixed location and locations at a rate such that the upper level C of charge material in the hopper is at all times substantially above the highest part of transition portion 24. As the charge material passes into and out of, the chutes, the charge material in the hopper that passes into the chutes is divided by the transition portion 24 so that each opening of the openings 42–47 of the chutes receives charge material in a proportion corresponding to the plan area of its corresponding segment. In the illustrated embodiment, moreover, the plan area of each segment 61–66 bears the same relationship to the total area of all segments, as the area of the zone at the stock line fed by such segment bears to the total area of all zones 54–59 at the stock line. In particular, in the illustrated embodiment the area of the annular zones 54–58 are essentially equal, while the area of the non-annular central zone 59 is smaller.

In the illustrated embodiment the area of the central zone 59 is approximately 50% of the area of the annular zones 54–58, but could be between approximately 25% to 75% of the area of the annular zones. The cross sectional area of chute 17 serving the central area is corresponding smaller than the cross sectional area of each of the other chutes, which areas are equal; the cross sectional areas of the chutes and their segmental feed portions 61–66 are so related that when charge material is initially fed into hopper 17, the chutes all become filled at substantially the same time, and when the charge material is no longer fed to the hopper the chutes are empty substantially simultaneously which is desirable to achieve the desired height and contour of stock line, and to avoid excessive stress on any part of the rotatable distributor means.

The central zone is substantially smaller, because if it was substantially equal to or larger than the area of the annular zones, the area of the central zone would be so large in a blast furnace of even moderate cross sectional area by present standards, that even reasonably level central zone could not be provided by a single chute; and if the area of the annular zones were made sufficiently smaller to permit a central zone of equal area to be adequately leveled, by a single chute, such annular zone would necessarily be so narrow as to be impracticable. Moreover, if all annular zones were made narrower, to be equal in area to a central zone that could be properly served by a single chute, then a larger number of annular zones, and hence chutes, would be required to cover the stock line cross section, thus adding substantially to the cost of the apparatus.

The parts could be designed so the areas of the stock line zones served by the chutes can be unequal.

Figure 9:
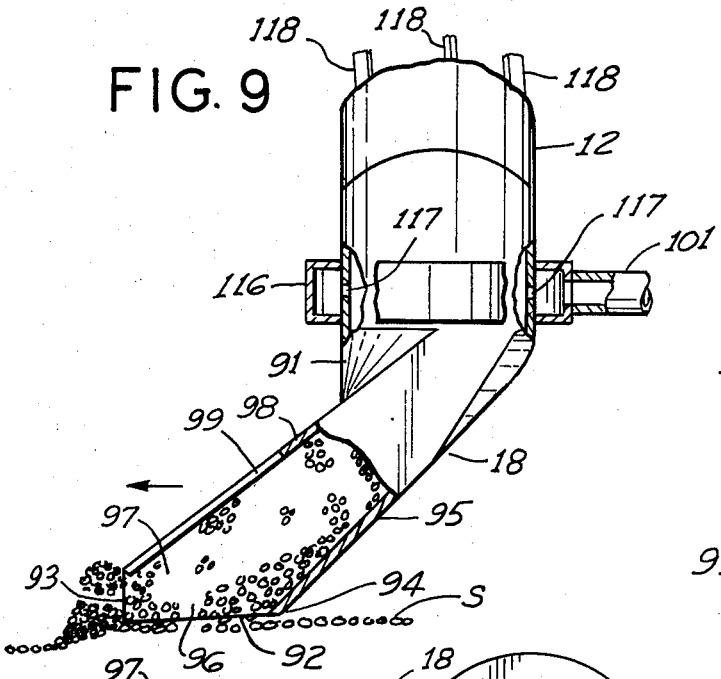
FIG. 9 is an enlarged view of the lower discharge portion of one of the chutes, parts being broken away.

The construction and operation of the discharge portion of each chute will be apparent from the following discussion, in connection with FIGS. 9–12 showing discharge portion 18 of chute 12. Each discharge portion comprises a vertical portion 91 into which the inclined portion of the chute discharges, if it has an inclined portion. The discharge portion has a bottom portion 92 that, when viewed from the side as in FIG. 9, is preferably substantially flat and offset from portion 91 toward the leading edge portion 93 of the discharge portion. The trailing edge 94 is defined by wall 95 that is inclined downwardly in a direction toward the leading edge. Bottom portion 92 has a discharge opening 96 that extends up into the leading end porton. The leading edge portion comprises upright side walls 97 and an inclined upper wall 98 that has a central recess 99 opening toward the leading edge and merging with opening 96. Charge material from the associated chute passing into the discharge portion is discharged from bottom opening 96 and recess 99 onto stock line S as the discharge portion moves in the direction of the arrows in FIGS. 9 and 11 when the distributor is rotated about its axis. Side walls 97 aid in locating the charge material properly transversely as it is laid down. Bottom portion 92 is preferably somewhat inclined upwardly toward the trailing edge 94, and in cooperation with the inside surface of wall 95, aids in providing a uniform height of charge material as it is laid down, without breakage or degradation of the particles of charge material, since higher portions of charge material in the stock line are in effect scooped into the distributor portion at wall 95, while lower portions at the stock line are filled by charge material supplied from the chute, as the discharge portion moves relative to the stock line.

Futhermore, as shown in FIGS. 1–4, the chutes are rigidly held in desired relation to each other and to the hopper 11 by radial reinforcing members 101–106 connected to the chutes and to central vertical member 107, and by transverse tie members 108–113. Members 101–106 may, if desired, be hollow and terminate at their inner ends in a hollow vertical member 107 that rotates with the hopper of the distributor and is supplied with suitable gas such as blast furnace gas or steam under pressure through known rotating and gas sealing connection 114 connected to supply pipe 115 (FIGS. 1, 2). The outer end of each member 101–106 then preferably discharges into an anular housing 116 (FIGS. 2, 3, 4, 9–11) at the discharge portion of one of each chute, which housing communicates through perforations 117 with the interior of the discharge portion to permit the gas to be discharged under pressure into such portions. Such gas can prevent jamming or blocking of charge material flowing through the chute and out of its discharge portion. It also makes possible corrective action in starting flow of charge material after blocking has occured; in such case application of gas under pressure lifts and tends to fluidize the blocked charge material, and cutting off of gas pressure then permits the charge material to drop and commence flowing. Such gas can also purge the chutes and prevent escape of undesired gas from the furnace throufh the chutes.

Moreover, each of the chutes, and preferably its corresponding segmented portion of the transition portion 24 of hopper 11 at the upper portion of the chute, and also preferably its discharge portion at the lower end of the chute, are constructed and arranged to provide continuous uninterrupted mass flow of the charge material through the chute without jamming or locking of material in the chute. In such mass flow, the particles in essence move together through the chute without substantial redistribution of particles in the charge material. In the embodiment under discussion, the mass of charge material flowing through the chute is rotated about or between the longitudinal axis of the chute. Consequently, any tendency for finer particles to settle vertically downward in an inclined chute portion while larger particles tend to move longitudinally of the axis of the chute, is negated because the rotationed effect imparted to the material passing through the chute causes the smaller particles to mix back with the coarser particles as soon as the finer particles start to segregate. Similar benefits occur in the vertical portions of the chutes. Consequently, the charge material discharged from the distributor portion of each chute at the stock line is substantially free of segregation.

In the embodiment of FIGS. 1–12, each of the chutes (FIGS. 1, 2, 4, 6, 9, 10, 12) has fixed to its internal wall a plurality, three in the illustrated embodiment, of helical vanes or flights 118 equiangularly spaced about the circular inner walls of the chutes. These vanes extend helically substantially throughout the length of the inclined portion of each chute, and preferably, as shown, through the vertical portions of the chutes and preferably also into the distributor portions of the chutes. The vanes twist or rotate the mass of charge material as it proceeds downwardly through each chute, thus mixing the finer materials back with the coarser materials as soon as the finer materials start to segregate, which tendency occurs particularly in the inclined portions of the chutes, because the finer particles tend to drop vertically while the larger particles tend to travel along the axis of the inclined chute portion. The vanes therefore prevent segregation by causing the particles of different sizes to remain intermixed as they pass downwardly through the chute. Preferably each vane extends through at least 90° of transverse arc in the shorter inclined portions, and through at least 180° of transverse arc in the longer portions of the chutes. Preferably the vanes extend through at least 360° of arc in the entire length of chute. Preferably, the vanes provide a twist angle of approximately 5° per foot of chute length, but they may advantageously provide twist angles of from approximately 3° to 9° per foot of chute.

Moreover, in this illustrated embodiment, a rotational or twisting effect is also imparted to the charge material as it passes through the transition portion 24 of the chute. As is apparent from FIGS. 2, 4–7, the portions of which define each segment of the transition portion in each chute are so designed that the inner surface and junctures between the surfaces impart a helical twisting effect to the charge material passing through such segments. The twist angle is preferably the same as in the chutes.

Figure 10:
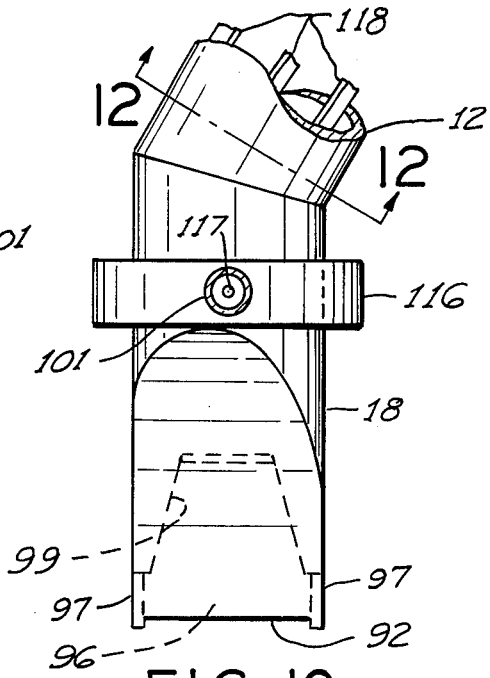
FIG. 10 is a view from the right side of FIG. 9.
Figure 11:
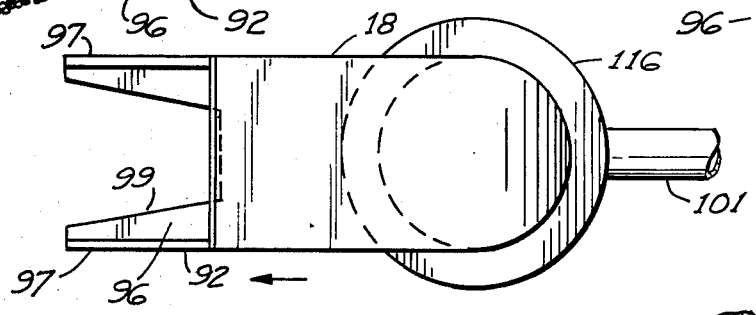
FIG. 11 is a view from the bottom of FIG. 9.

Furthermore, each discharge portion is preferably so constructed and arranged that, as shown in FIGS. 9–11, it imparts a helical twisting effect to charge material passing through the discharge portion to the stock line, the twist angle being the same as in the chutes.

When, as in the embodiment of FIGS. 1–12, each chute has helical vanes through its length, including the vertical portions as well as inclined portions, and its associated segment of the transitional portions between the hopper and chute and the associated distributor portions are constructed to cause rotation of the flowing mass of charge material in the same rotational direction as it flows by gravity through these portions from the hopper to the stock line, important benefits are provided.

Thus, the beneficial mass flow and anti-segregation effects discussed above are accentuated since they are imparted to the charge material flowing through each chute throughout its path of flow from the hopper to the stock line. Moreover, since the parts are constructed to impart a rotary effect to the charge material throughout its paths of flow, there is no portion of the path where the charge material can flow without rotation. Consequently, there are little if any shear or relative particle movements and energy absorption between rotating and non-rotating portions of the mass of charge material in the paths of flow, that could impede or block flow of the material.

Furthermore, other important benefits can be achieved by constructing and arranging the chutes, and preferably other transition portion segments and their distributor portions, so that opposite rotational effects are provided in the chutes, preferably in adjacent chutes, as illustrated by FIGS. 1, 2, 3 and 5. In these figures, the same rotational direction effects are provided in alternate chutes, and chutes between them have appropriate rotational effects. When this is done, shear effects are minimized or eliminated between twisting masses of charge material in the hopper connected to the chutes, and greater uniformity of distribution achieved.

Figure 14:
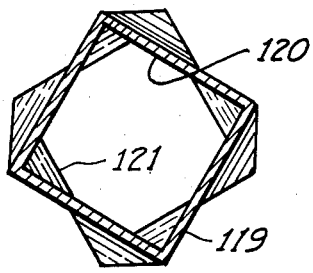
FIG. 14 is an enlarged section along line 14—14 of FIG. 13.
Figure 13:
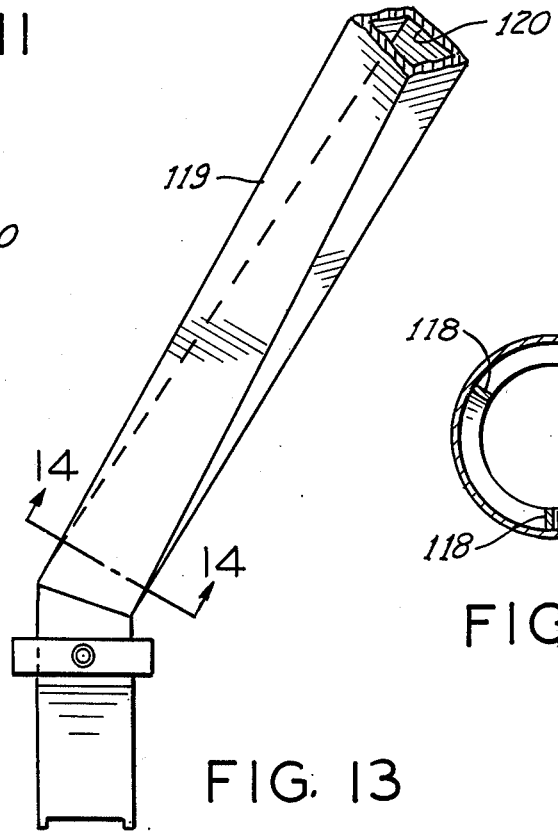
FIG. 13 is a side view of a chute discharge portion and another embodiment of the chute in which the chute itself is formed to be helically twisted along its axis.
Figure 12:
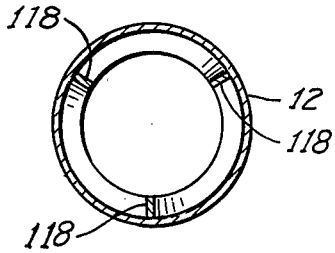
FIG. 12 is a section along line 12—12 of FIG. 10.

Other means may be applied to impart the rotational or twisting effect to the charge material passing through the chutes. Thus, the chutes can be made with unvaned tubular portions 119 having an internal passage 120 preferably of square, but if desired, of other non-circular internal cross section and be constructed so the internal passage of such cross section is helically twisted along its length as shown at 121 of FIGS. 13 and 14, which show the lower portion of a chute and a discharge portion that may be like the discharge portion previously described. The polygonal cross section of the twisted chute effectively provides the beneficial rotational or twisting action to the charge material flowing through the chute. A twist angle as described above may be used.

Furnace 1 has at its upper portion a plurality of gas lock members 124 into which charge material is supplied from a rotatable external hopper 125, into which charge material is discharged by a conveyor 126. Hopper 125 is supported for rotation by rollers 127 engaging a ring member 128 rigidly mounted on the hopper, and is rotated by a gear 129 engaging teeth on member 128 and driven by suitable power means 130. Hopper 125 has a discharge opening 132 at its lower portion adapted to be opened and closed by a closure member 133 operated by lever 134 driven by suitable power means 135, so that the hopper can be opened to discharge material at the appropriate time and be closed the remainder of the time.

Each gas lock member 124 (FIG. 2) comprises a chamber 136 having an upper charge receiving portion 137 and adapted to be closed and opened as required by a known type of gas valve 138 actuated in known manner by known means. The lower portion of the gas lock chamber 136 has a material-holding gate valve 139 adapted when closed to support charge material discharged into the gas lock chamber and adapted to be opened and closed by a suitable fluid powered cylinder 140. Below the material holding valve is another gas valve 141 adapted to be opened and closed as required by suitable known means.

In operation of the illustrated blast furnace apparatus, charge distributor means 10 is rotated about its axis A by its power means. Charge material is delivered, preferably continuously by conveyor 126 to hopper 125 which is intermittantly rotated to align its discharge opening 132 with the receiving portion 137 of each selected one of the gas lock members 124. The selected gas lock member gas valve 138 is then opened, and the closure member 133 of hopper 125 is actuated to open discharge opening 132 of hopper 125 and permit a predetermined amount of charge material to drop into the chamber 136 of the selected gas lock member, in which chamber the material is supported by closed gate valve 139. Upper gas valve 138 is then closed, the lower gas valve 141 is then opened, after which the gate valve 139 is opened to permit charge material to drop into hopper 11 of the distributor means 10. Gate valve 139 and lower gas valve 141 are then closed. Charge material is thus introduced into the furnace without loss of gas pressure or harmful leakage of furnace gas. Upper rotatable hopper 125 may then be moved to another selected gas lock member and the procedure repeated.

Rotatable charge distributor 10 may be rotated continuously at uniform speed, or at a variable speed as described later; or even intermittently; but preferably it is rotated continuously and charge material is fed to it through the gas lock members as described above sufficiently frequently for continuous operation. Hopper 11 of distributor means 10 at all times during operation contains sufficient charge material to cover to a substantial depth the highest part of transition portions 24, as to a height C.

The above discussed distributor means, therefore, is such that as it rotates charge material deposited in the hopper 11 and maintained at height C flows by mass flow to and through the chutes and their discharge portions, being distributed into the various chutes in proportion to the area to be covered by each chute during its rotation, so that a stock line S of the desired contour of charge material is established and maintained at a desired height in the furnace. In the above discussed embodiment the stock line is shown as flat in FIGS. 1 and 2, but it is to be understood that stock lines of different contours, either concave, convex, or concave and convex, can be achieved by proper design of the apparatus to discharge the proper amounts of charge material. Moreover, because of the features indicated above, charge material charged by each chute is not segregated appreciably, if at all, so that the charge material is deposited in the furnace to form a body of particulate charge material that is of a substantially uniform admixture of large and small particles throughout the material charged, thus minimizing possibilities of channeling of gases through the charge material in the furnace or other undesirable results. Moreover, such homogeneity of the charge material and freedom from clinkering enables the charge material to pass downwardly through the furnace without hang-ups or jamming, thus facilitating the desired action on the iron oxide material, with consequent increased efficiency of operation and product quality.

Figure 15:
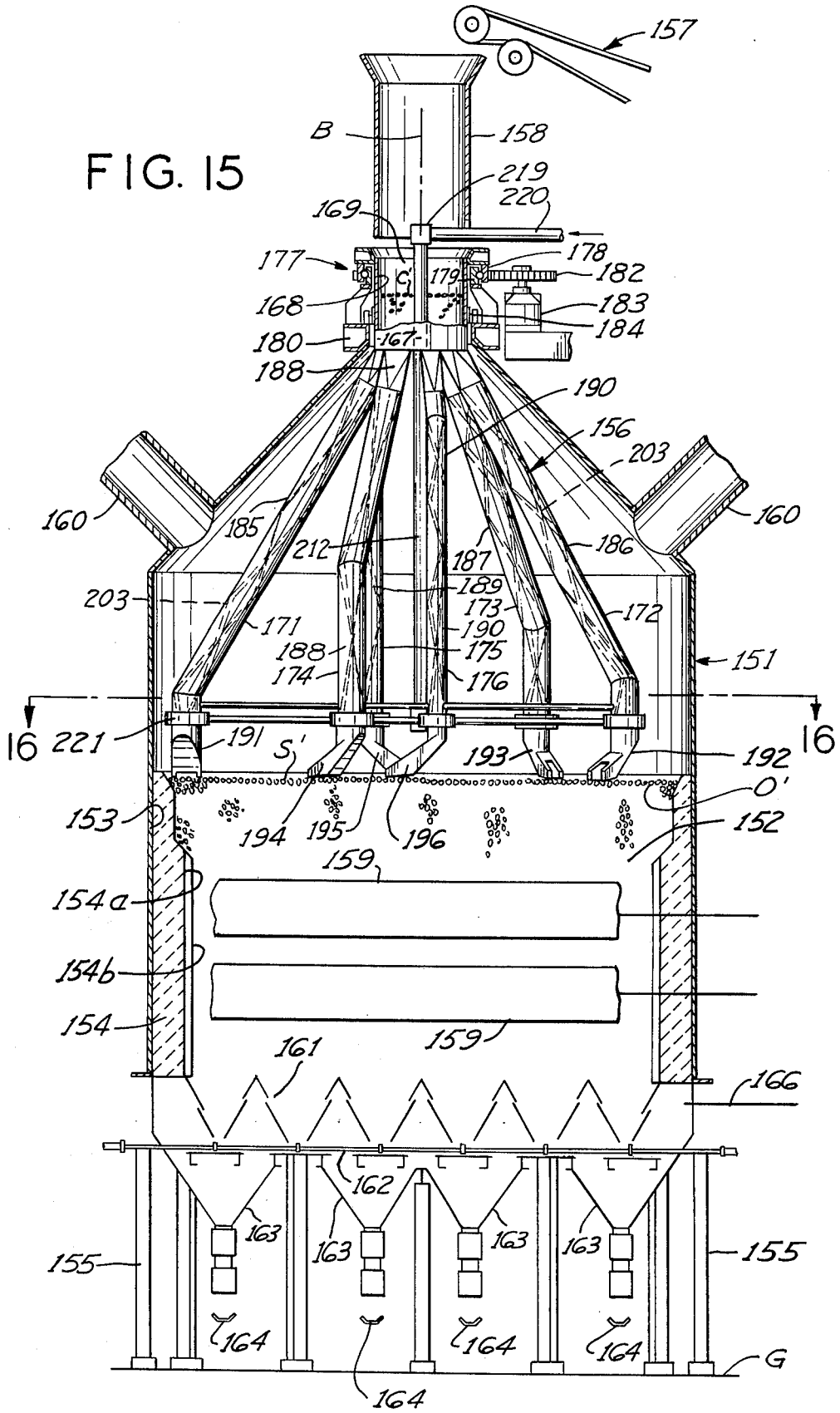
FIG. 15 is a vertical section through an oil shale retort apparatus embodying the present invention.
Figure 16:
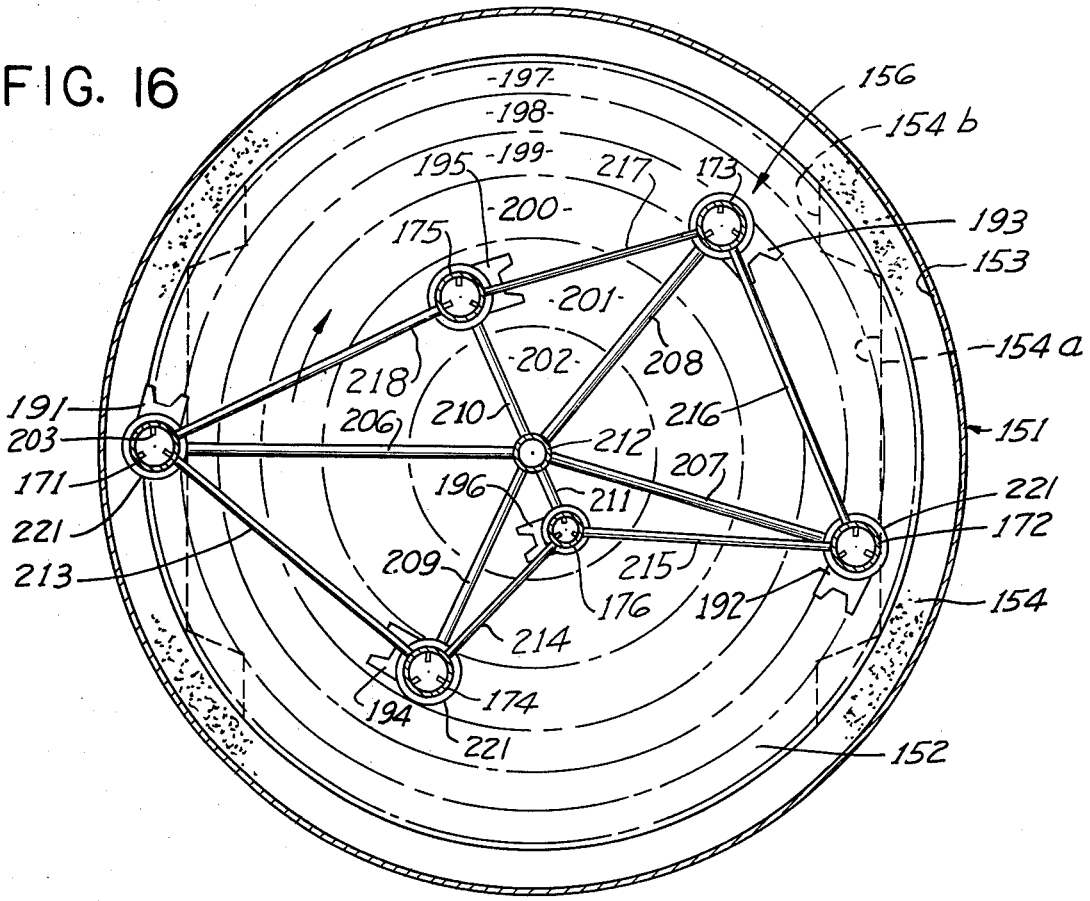
FIG. 16 is a section along line 16—16 of FIG. 15.

FIGS. 15 and 16 depict an upright retort 151, embodying the invention, for the recovery of oil from crushed particulate oil shale. It comprises an upright furnace portion or chamber 152 having a metal shell 153 lined with heat resistant material 154 adapted to contain a body of particulate oil shale. Chamber 152 is supported by legs 155 from the ground G and is essentially circular about a vertical axis B at the stock line, but below the stock line has flat portions 154*a* and protuberances 154*b* required for support of other parts internally of the chamber.

In its upper portion, chamber 152 has rotatable charge distributor means 156, similar to that described above, embodying the invention, by which crushed particulate oil shale supplied by conveyor 157 and discharged into stationary hopper 158 can be discharged by the distributor means 156 to form body O′ of oil shale and maintain a level stock line S′ of the desired contour at the desired height in the chamber 152. The oil shale supplied by distributor means 156 passes downwardly and is heated by burning of a fuel gas-air mixture supplied through suitable gas-air distributor means 159. The heated gases pass upwardly through the portion of the body of oil shale above the gas-air distributor means, and a mixture of gas, water vapor, and oil and other vapors passes out of chamber 152 through conduits 160 for recovery of oil, gas and other recoverable material in known manners.

The spent oil shale from which oil and other constituents has been thus removed, passes downwardly below the gas distributor means, being supported by and discharged by, grate means 161 of known construction which has reciprocatory members 162 by which the spent oil shale is discharged into hoppers 163 and from them onto conveyors 164 which remove it.

Air is supplied at a predetermined rate and volume into the lower portion of the chamber 152 through the conduit means 166. Air thus supplied is heated as it passed upwardly through the hot spent shale, cooling the shale, and providing a predetermined amount of oxygen for aiding in supporting combustion at the gas-air distributor means 159.

The rotatable charge distributor means 156 comprises an upper hopper 167 having an upstanding cylindrical side wall 168 providing an open top 169. A plurality of downwardly extending chute members 171, 172, 173, 174, 175 and 176 are rigidly fixed to the bottom of hopper 167 and rotate with it about axis B. The hopper is rotatably supported, and hence rotatably supports the chute members, from a thrust-type anti-friction bearing 177, the outer race 178 of which is fixed to the exterior of the hopper and the inner race 179 of which is mounted on frame 180 of the apparatus. The outer bearing race has radially outwardly extending gear teeth engaged by a pinion 182 rotated by suitable power means 183 such as an electric motor to rotate the hopper and chute members as required. Suitable gas sealing means 184 is shown as provided to seal the joint between the shell 153 and exterior of the hopper wall 168 against escape of gas or vapors from the interior of chamber 152.

The chute members 171–176 respectively have downwardly extending tubular portions 185 to 190 of which portions 185, 186, 187, 188 and 189 have inclined portions of substantial lengths. The upper ends of all tubular portions 171–176 respectively open into the hopper 167 through a transition portion 188 like that of the previous embodiment, and the lower ends respectively have discharge portions 191–196.

The discharge portions of the chutes respectively are located at spaced positions angularly around the axis of rotation B, as in the previous embodiment, at different distances radially from axis B, so that each discharge portion discharges charge material in a corresponding circular zone of zones 197–202 that in total cover the entire area of cross section of the retort at the stock line S′. In this embodiment, as in the previous embodiment, the central zone 202 is not annular, but all others are annular; and annular zones 197′201 all have substantially the same area; and central zone 202 has between about 25 percent to 75 percent, and preferably about 50 percent; of the area of each annular zone, for the reasons discussed above.

The transition portion 188 at the juncture of the lower portion of hopper 167 and each of the upper openings of the chutes is divided to provide segments, as in the previous embodiment, so that the charge material deposited in the hopper as it rotates is divided among the chutes in such a manner that the amount of charge material passing through each chute and discharged from its lower discharge portion during one revolution of the chute is sufficient to deposit in the corresponding zone served by such discharge portion an amount of charge material that fills the area of the zone to a predetermined height preferably corresponding to the same height of charge material deposited in the other zones if a flat stock line S′ is desired. Consequently, a highly uniform bed of charge material is laid down entirely across the cross section of the retort. Preferably the thickness of the layer of charging material normally laid down by each chute discharge portion is somewhat greater, but not largely greater than the cross sectional dimension of the larger particles of oil shale; most particles would range from about ¼ inch to 4 inches in size, and the thickness of the layer of charge material normally laid down is about 5 inches.

While the hopper is rotating and is supplied with charge material from a fixed location or locations, it is maintained partially filled with charge material to a level at all times above the transition portion and each chute receives al charge material that is directed by its corresponding segment. In the illustrated embodiment, moreover, as in the previous embodiment, the plan area of each segment bears the same relationship to the total area of all segments, as the area of the circular zone at the stock line fed by such segment bears to the total area of all circular zones at the stock line.

Moreover, each of the chutes has fixed to its internal wall a plurality of helical vanes or flights 203 that extend helically at least through the length of the inclined portion of each chute, and preferably through the length of the chute. These vanes act as in the previous embodiment to rotate or twist the charge material flowing through the chutes, providing continuous uninterrupted mass flow of charge material to, through, and out of the chutes, and avoiding segregation between larger and smaller particles of charge material in the charge material deposited at the stock line. As explained above, the vanes avoid segregation by causing the particles of deposited charge material of different sizes to remain intermixed as they pass downwardly through the chute. Of course, other means, such as that illustrated in FIGS. 13 and 14, may be used to impart a rotational effect to the charge material as it passes through the chutes to achieve the indicated desirable effects.

The construction and operation of the discharge portions of each chute may be identical with those of the discharge portions discussed above and so need not be further described.

Preferably, in the above embodiment as well as in other embodiments, the chutes are designed so that they impart a rotational twist or helical effect to the charge material passing through the chute of between 3° to 9° per foot and preferably in the neighborhood of 5° per foot. This degree of twist preferably is also provided in the segment of the transition zone for each chute as well as in the discharge portion of each chute, as discussed above in connection with the previous embodiment.

Furthermore, in each of these embodiments, as in the preceding, the direction of rotation in alternate chutes is alternately right-hand and left-hand to minimize the shear between twisting masses of solids in the rotating hopper above the chutes. However, all of the chutes and their associated transition portions and discharge portions can be made to impart the same direction of rotation to the charge material passing through the chutes if desired.

Furthermore, as shown in FIGS. 15 and 16 the chutes are rigidly held in desired relation to each other and to the hopper 167 by radial reinforcing members 206–211 connected to the chutes and to central vertical member 212 and by transverse tie members 213–218.

Members 206–211 may, if desired, be hollow and terminate at their inner ends in a hollow vertical member 212 that rotates with the hopper of the distributor and is supplied with suitable, preferably oxygen-free purge gas, such as recycled combustion gas, under pressure through known rotating connection 219 connected to supply pipe 220. The outer end of each member 206–211 then preferably discharges into an annular housing 221 at the discharge portion of one of each of the chutes, which housing communicates with the interior of the discharge portion, to permit the gas to be discharged at a pressure greater than the pressure in the retort chamber above the stock line into the discharge portions. This can prevent or correct blocking of the discharge portions with charge material; and also insures that any gas passing upwardly from the interior of the retort chamber through the chutes and hopper to the atmosphere is not combustible or oil-vapor containing gas which, if discharged to the atmosphere, could result in loss of product or even danger.

Therefore, in the embodiment of FIGS. 15, 16 charge material deposited in the hopper 167 by the illustrated means is distributed into the various chutes in proportion to the area to be covered by each chute during its rotation, so that a stock line S′ of the desired contour of charge material is established and maintained. In the illustrated embodiment the stock line is shown as flat, but it is to be understood that stock lines of different contours, either concave, convex, or concave and convex can be achieved by proper design of the apparatus to discharge the proper amounts of charge material. Moreover, because of the features indicated above, charge material charged by each chute is not segregated appreciably, if at all, so that the charge material is deposited in the retort to form a body of particulate oil shale that is of a substantially uniform admixture of large and small particles throughout the body, thus preventing channeling of gas through the charge material, or other undesirable results. Moreover, such homogeneity of the charge material and freedom from clinkering enables the particulate oil shale to pass freely between spaced parts of the gas-air distribution means 159, without hang-ups or jamming, thus permitting proper heating of the shale and volatilization of the oil-containing and other desirable constituents of the charge material.

In operation of the above and other embodiments of the invention, moreover, charge material is supplied to the upper hopper of the charge distribution means at a rate so that there is continuously a mass of charge material in the hopper the upper level of which is located substantially above the level of the transition zone, so that at all times there is adequate charge material to pass into all of the transition zones and their associated chutes. Moreover, in operation, the chutes are continuously and uninterruptedly substantially full of charge material.

However, in some circumstances, there are conditions within the receptacle into which charge material is being charged that in operation of the apparatus of which the receptacle is a part, cause variations in the rate of lowering of the charge material within the areas of one or more of the circular zones at the stock line, which variations could cause difficulties since the discharge portions of the chutes all move in substantially annular paths. More rapid or slower lowering of portions of the stock line could arise because the inner wall of the receptacle at or below the stock line is not of perfectly round cross section, as shown in FIG. 16, so the charge material in the body would have to move downwardly at different rates in larger or smaller cross sectional portions; or because of malfunction of processing equipment such as a blast furnace or retort, or because of an upset in the process conditions as could be caused by localized bridging, or because of other reasons. In such cases difficulties could arise as described below.

For example, as charge material is being deposited into an oil shale retort, the withdrawal mechanism at the bottom of the retort might move more or less material per unit area than elsewhere. If the normal stock line moves downwardly, say four inches during one revolution of the distributor means, and if the material in a particular circular zone moves eight inches down due to such operation of the withdrawal mechanism or other reasons, a low spot four inches deep would occur at the stock line, which of course would be filled each time the discharge portion covering such low portion would pass over it. However, this would require considerably more material to move from the upper hopper into the particular chute serving such discharge portion. This could result in a low spot or depression, as much as two feet deep, in the upper surface of the charge material in the hopper.

As the rotating hopper comes under the fixed location at which charge material is charged into the hopper, large particles of charge material would tend to roll into such depression in the upper surface of the charge material in the hopper, whereas finer particles would not tend to roll into such depression. Consequently, in the hopper there would be a location in the charge material above one or more segments in the transition portion which would contain segregated large particles of material which if it passed downwardly through the chute or chutes would cause a localized portion of segregated large particles of material to be laid down in the receptacle. In a retort, or blast furnace, or other apparatus involving passage of gas through a body of particulate charge material in a receptacle, this could result in channeling of the gas through the portion of the charge material in the receptable containing the segregated larger particles.

According to the present invention, these problems can be eliminated. For convenience a solution to the problem is diagrammatically shown in FIGS. 17 and 18 inclusive which is a diagrammatic showing of the upper portion of distributor means embodying the invention, such as those disclosed previously, for an oil shale retort apparatus similar to that of FIG. 15.

Figure 17:
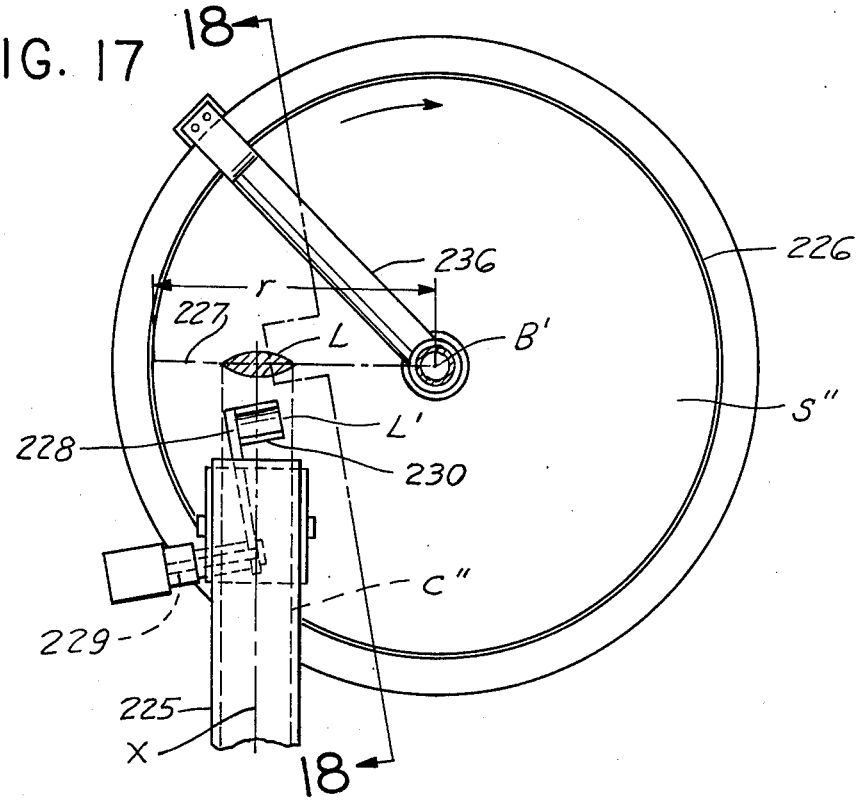
FIG. 17 is a plan of a hopper of a distributor embodying the invention, equipped with means for controlling the level of charge material in the hopper.
Figure 18:
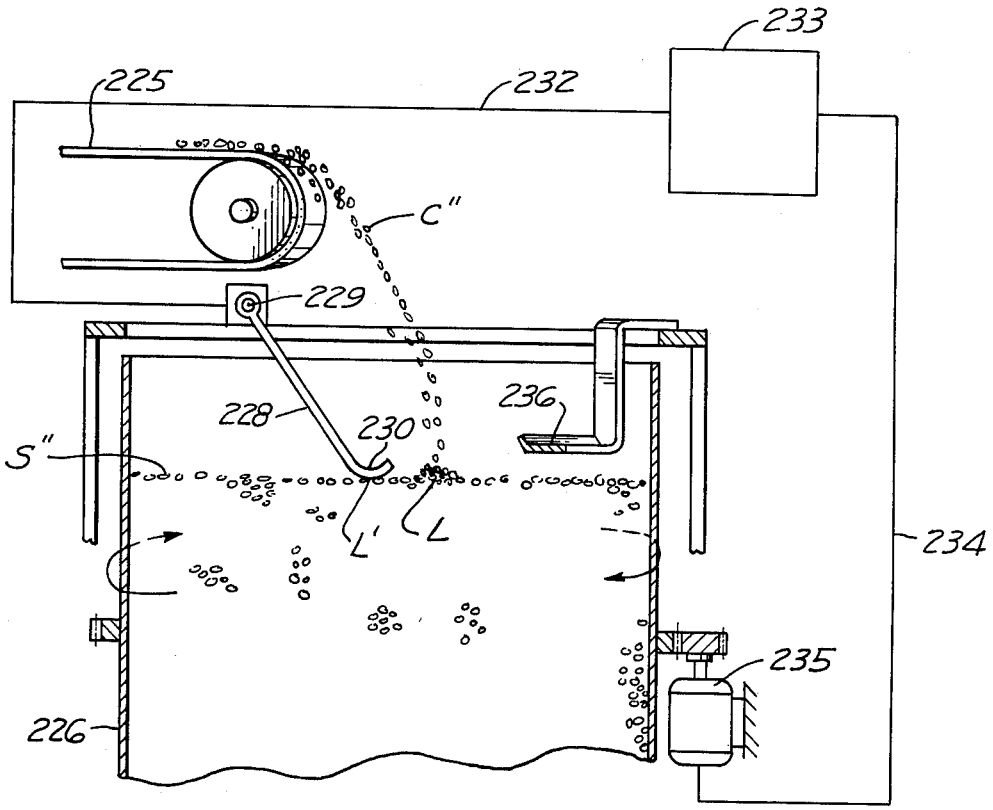
FIG. 18 is a section along line 18—18 of FIG. 17.

As shown in FIGS. 17 and 18, a conveyor 225 bringing particulate charge material C″ to the hopper 226 as it rotates about axis B′, discharges the material into an area L at a fixed location lying along a fixed radius 227, having a length *r*, of the hopper, area L being generally elliptical with its major axis along such fixed radius of the hopper. The longitudinal axis X of the conveyor is normal to such radius 227 and is located at a distance substantially 0.707*r*,(*r* divided by the square of 2) from axis B′, to achieve proper distribution of charge material entirely across the radius of the hopper with minimum transverse movement of the charge material along the radius.

According to the invention, moreover, means may be provided for insuring that the upper surface S″ of the charge material in the hopper is substantially at predetermined height above the bottom of the hopper and above the transition portion between the hopper and its chutes, and substantially level in a circular direction about the axis of rotation of the hopper.

The means illustrated for this purpose comprises a charge level sensor 228 (FIGS 17, 18), such as a known paddle-type level sensor element that is pivotally mounted at 229 about a fixed horizontal axis so that its lower sensing portion 230 senses the level and height of the charge material in the hopper at a location L′ in front of the location L at which charge material is deposited in the hopper. This paddle sensor is connected, preferably electrically, by known means 232 to known means 233 such as a computer type control unit that is connected by known means 234 to control the operation of motor 235 that rotates hopper 226 and its attached chutes, about axis B′. The apparatus is designed so that the instantaneous speed of rotation of the hopper is controlled in such a way that the hopper will be positioned under the feed location L at which charge material is deposited for a longer time than normal if the sensor senses a lower than normal height of material in the hopper at location L′, and conversely the hopper will be positioned under the location L a shorter time than normal if the sensor senses a higher than normal height of material at location L′. The apparatus controls the speed of rotation of the hopper, through a time delay so that the speed of the hopper is suitably varied as the excessively high or low portion of charge material approaches, is under, and leaves location L. However, the control mechanism would make no change in the speed of rotation if the top surface of the charge material in the hopper is at a uniform height due to uniform feeding of material by each of the chutes and their corresponding discharge portions.

Furthermore, as shown in FIGS. 17, 18, a screed 236 is also provided at a level slightly above the normal height of charge material to be maintained in the hopper, to maintain a relatively level surface of the material in the hopper in the event malfunction of the rotating means for the hopper or of excessive discharge of charge material from the conveyor belt adversely affects the ability of the sensing and control means to vary the speed of rotation of the hopper to provide the desired leveling effect. The screed means illustrated is a skid that drags material into depressions if they occur in the upper surface of the charge material in the hopper, and levels off protuberances at such surface of charge material if they occur.

While the invention has been discussed in connection with charging and distribution of charge material into an iron ore blast furnace and to an upright retort for recovery of oil from oil shale, the invention may be used for charging material into other receptacles, such as chambers of coal gasifiers, pyroprocessing preheaters, kilns and pyroprocessing coolers.

Furthermore, means other than the disclosed may be used for insuring that the proper amount of charge material flows into each of the chutes, for maintaining the proper height of charge material in the rotating hopper, and for providing the desired rotational effect to material flowing through and out of the chute for the indicated purposes.

Other modifications may also be made in the illustrated embodiments without departing from the spirit of the invention.

While the invention has been shown and described with respect to certain specific embodiments thereof, this is intended for the purpose of illustration rather than limitation, and other variations and modifications of the embodiments herein shown and described will be apparent to those skilled in the art, all within the intended spirit and scope of the invention. Accordingly, the patent is not to be limited to the specific embodiments herein shown and described, nor in any other way that is inconsistent with the extent to which the progress in the art has been advanced by the invention.

I claim:

1. Apparatus for charging particulate charge material into a receptacle, comprising a receptacle adapted to have particulate charge material deposited therein in a body having an upwardly facing stock line; and charge distributing means for distributing charge material in said receptacle, said charge distributing means being rotatable about an upright axis and comprising hopper means rotatable about said axis and having an upper portion adapted to have charge material discharged therein and having at its lower portion a plurality of discharge chutes rigidly fixed to said hopper means, and being adapted to have charge material flow from said hopper means through said chutes, each of said chutes having an upper entrance opening and a lower discharge portion that moves in a circular path concentric with and transverse to said axis of rotation as said charge distributor means rotates, the discharge portions of said plurality of chutes being located so they discharge material in concentric generally circular zones that have predetermined areas of essentially the same cross-sectional areas and that are radially offset in the receptacle so that the material discharged from said discharge portions is discharged over at least a major portion of cross section to said stock line, and means between said hopper means and the entrance openings of said chutes for dividing charge material discharged into said chutes into portions that pass into said chutes and are proper to fill said areas of said circular zones as said hopper means rotates.

2. The apparatus of claim 1 in which each of a plurality of said chutes has means extending along a substantial portion of its length of the interior of said chute to impart a rotational effect to charge material passing through said chute.

3. The apparatus of claim 2 in which chutes having adjacent entrance openings alternately have means to impart opposite rotational effects to charge material flowing through said chutes.

4. The apparatus of claim 2 in which said means includes a plurality of helical vanes in each of said chutes.

5. The apparatus of claim 2 in which each of said chutes has a tubular passage of internal polygonal cross section that is helically twisted along the axis of a substantial length of said chute passage.

6. The apparatus of claim 1 in which said discharge portions of said chutes have openings at their bottoms which discharge downwardly, and in which said openings all lie in substantially the same plane normal to said axis of rotation.

7. The apparatus of claim 1 in which the majority of said circular zones have the same cross sectional area.

8. The apparatus of claim 1 in which the central circular zone is not annular and has an area of approximately 25 percent to 75 percent of the area of each of said other circular zones, which are annular zones.

9. The apparatus of claim 8 in which said central zone is approximately 50 percent of the area of each of said other zones.

10. The apparatus of claim 1 in which said means for dividing charge material into said openings of said chutes divides said charge material in proportions that will cause said discharge portions of said chutes to deposit charge material in the proper amounts in said circular zones to cover the cross section of said stock line substantially to a predetermined height during each revolution of each of said chutes about said axis.

11. The apparatus of claim 1 comprising means for supplying gas under pressure to the interior of the lower end of each of said chutes.

12. The apparatus of claim 1 in which the lower portion of said hopper means has a cross section transverse to said axis that is divided into a plurality of segments, one for each chute, each of which segments bears the same relationship to the total area of all said segments of said hopper as the associated zone of the stock line in said furnace bears to the total area of all the zones which comprise the stock line.

13. The apparatus of claim 1 in which the discharge portion of each of a plurality of chutes has a bottom portion adapted to level the charge material at said stock line to form a level stock line.

14. The apparatus of claim 1 which is an oil shale retort and in which said receptacle is an oil shale retort chamber, and in which said charge distributing means charges oil shale into the upper portion of said chamber to form in said chamber a body of particulate oil shale having a top surface, and means at the lower portion of said chamber for discharging spent oil shale.

15. The apparatus of claim 1 comprising means for maintaining in said hopper means as it rotates a body of charge material the top surface of which is substantially above said charge dividing means and which is substantially level.

16. The apparatus of claim 15 comprising means for supplying charge material to said hopper means in a substantially continuous stream at a substantially continuous rate, means for sensing the height of said top surface of said charge material with relation to said hopper means, and means for varying the speed of rotation of said hopper means to maintain a substantially level top surface.

17. The apparatus of claim 1 comprising means for providing mass flow of charge material through said chutes.

18. The apparatus of claim 17 in which said means provides mass flow of charge material throughout the lengths of said chutes.

19. The apparatus of claim 17 in which said means provides mass flow throughout said means for dividing charge material, through the length of said chutes, and through the discharge portions of said chutes.

20. The apparatus of claim 17 in which said means provides twisting mass flow of charge material through substantial portions of lengths of said chutes.

* * * * *